United States Patent [19]

D'Amico

[11] Patent Number: 5,042,811

[45] Date of Patent: Aug. 27, 1991

[54] GOLF CLUB SWING TRAINER

[76] Inventor: Joseph S. D'Amico, 19 Craigwood Cir., Russellville, Ark. 72801

[21] Appl. No.: 490,369

[22] Filed: Mar. 8, 1990

[51] Int. Cl.[5] ..... A63B 53/14

[52] U.S. Cl. ..... 273/165; 434/252; 273/81 D

[58] Field of Search ..... 434/252, 242; 273/165-166, 81 D, 81 R, 81.2, 81.3, 81.4, 81.6, 183 B

[56] References Cited

U.S. PATENT DOCUMENTS

| | | | |
|---|---|---|---|
| 2,723,125 | 11/1955 | Comee | 273/163 A |
| 2,938,728 | 5/1960 | Green | 273/81 D |
| 2,962,288 | 11/1960 | Lowden | 273/81.4 |
| 3,533,630 | 10/1970 | Monaco | 273/165 |
| 4,804,181 | 2/1989 | Foster | 273/81 D |

FOREIGN PATENT DOCUMENTS

| | | | |
|---|---|---|---|
| 1625 | 1/1899 | United Kingdom | 272/67 |
| 322512 | 12/1929 | United Kingdom | 273/81 D |

*Primary Examiner*—Richard J. Apley
*Assistant Examiner*—Rachel M. Healey
*Attorney, Agent, or Firm*—Richard C. Litman

[57] ABSTRACT

A device for weakening the right hand grip on a golf club in order to allow better extension in a swing for the left arm and club shaft. A body has three identations, two to be gripped by the thumb and middle finger of the right hand and a third indentation disposed between the other two for accepting the width of the golf club shaft. The body is gripped by the thumb and middle finger of the right hand and the third indentation is placed against the club shaft. The resulting grip maintains the positioning of a standard grip while at the same time weakening the right hand strength.

5 Claims, 1 Drawing Sheet

GOLF CLUB SWING TRAINER

BACKGROUND OF THE INVENTION

1. Field of the Invention

The present invention relates to golfing aids. More particularly, it relates to a training device for correcting a golfer's swing.

With a standard golf grip it is desired to have the left arm (assuming right handed golfers) act as a continuation of the golf club shaft. While swinging the club, the left arm and the golf club should act and feel as one extension. This ideal feeling is often prevented by the player's overpowering right hand. The right hand can cause a golfer to have a tendency to drag the club back or lead or lift the club head with his hands. It would be advantageous to be able to weaken the right hand while still being able to maintain a standard grip on the club.

2. Description of the Prior Art

The following is a discussion of patents felt to be related to, but do not disclose, whether taken singly or in combination, the applicant's unique invention.

U.S. Pat. Nos. 2,710,190, 1,855,126 and 1,075,054 issued to Schimansky, Connell and Morley respectively disclose permanent attachments to Golf club grips. These attachments allow a golfer to properly position his hands onto a golf club grip allowing him to grip the club more firmly. BY attaining a full right hand grip, the golfer can overpower his left hand, giving him an erratic ball trajectory.

U.S. Pat. No. 2,938,728 issued to Green discloses attaching an auxiliary handle to a golf club grip. Its stated intention is to give the right hand a weakened feeling on the down swing. This auxiliary handle separates the hands, which is contrary to any conventional golf swing. Having the two hands separated and operating independently, it becomes very difficult to coordinate any form of activity between them. In addition, the cantilevered handle allows a golfer a much greater mechanical advantage over his left hand, making it very easy for his right hand to overpower the left hand. Prior to a takeaway a golfer waggles his club and with this extra handle it makes this exercise impossible. Also on a takeaway, the right hand with this extra handle will lead the left hand throughout the complete back swing. At the top of the back swing, the elbow will be in what is called a flying elbow and in a strained position, meaning the elbow should be pointing down and not horizontal to the ground.

U.S. Pat. No. 1,690,312 issued to Rosan discloses a golf club grip that a player uses to grasp the grip portion of the club. It is U-shaped and snaps over the shaft of the club grip. This device will not allow the golfer to actually grip the club directly or correctly. The shape of the additional grip will not conform to the standard grip of the bare club.

U.S. Pat. No. 4,361,326 issued to Kokes discloses adding a layer of padding to a golf club grip under the player's right hand. This added rubber padding will compress by gripping, giving a golfer a solid grip onto the golf club, in affect the golfer will have a strong right hand overpowering.

What is needed and is shown to be missing from the prior art is a means of weakening the player's right hand strength while still maintaining a proper standard grip on the golf club grip.

SUMMARY OF THE INVENTION

Accordingly, it is one object of the present invention to provide a golf club swing training device that is held against the golf club grip between the thumb and middle finger of the right hand as the player holds the club in standard grip with both hands.

It is a further object of the present invention to provide a golf club swing training device that is separate from the golf club, allowing a golfer to carry the golf club swing trainer in his pocket and allowing him to call on it while playing golf in the event he is playing an erratic game.

It is another object of the present invention to provide a golf club swing training device that is capable of being utilized with standard golf clubs.

It is still another object of the present invention to provide a golf club swing training device that is molded from one piece.

These and other objects of the present invention will become readily apparent upon further review of the following specification and drawings.

BRIEF DESCRIPTION OF THE DRAWINGS

Similar reference characters denote corresponding features consistently throughout the attached drawings.

A DETAILED DESCRIPTION OF THE PREFERRED EMBODIMENT

Figure 1:
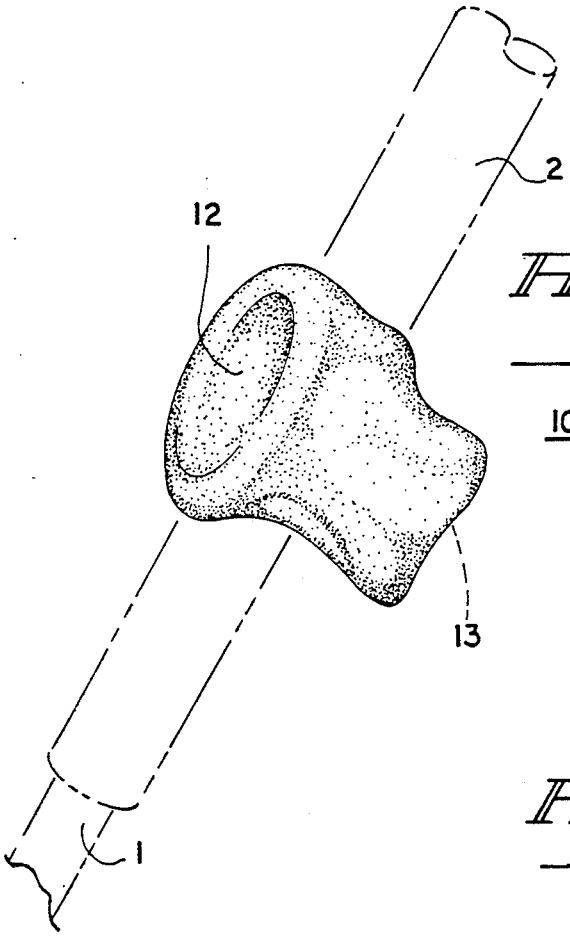
FIG. 1 shows a perspective view of the present invention.
Figure 2:
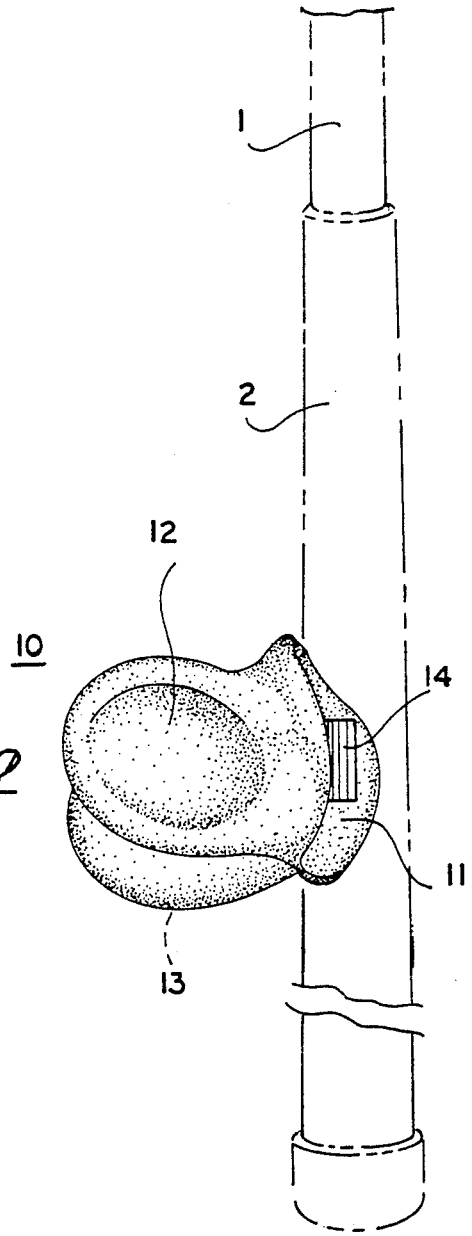
FIG. 2 shows another perspective view of the present invention.
Figure 3:
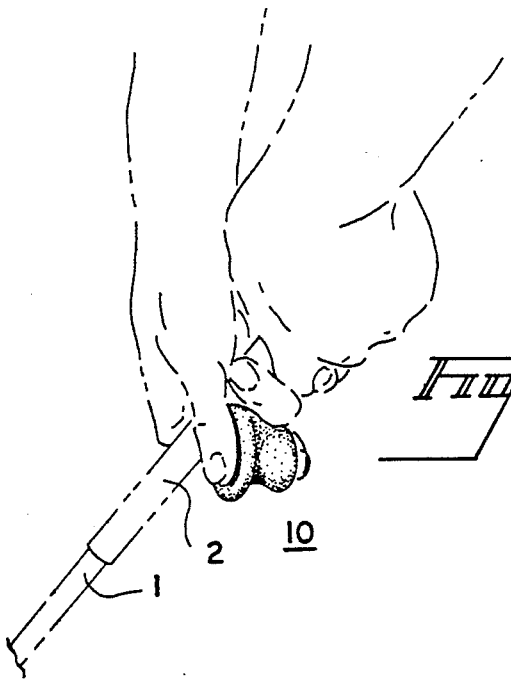
FIG. 3 is a view showing the present invention in use by a golf player.

The present invention 10 shown in FIG. 1 comprises a one piece molded plastic unit of generally hyperboloidal configuration. It has three major indentations 11, 12, 13. Indentation 11 is a substantially semicircular groove for placing the unit 10 against the grip portion 2 of a standard golf club 1. Placed adjacent the first indentation 11 and opposite each other are the two indentations 12 and 13 have substantially elliptical recess surfaces that accept the player's thumb and middle finger of the right hand. The standard grip is shown in FIG. 3. The present invention separates the thumb and middle finger of the right hand in order to weaken its strength in affecting the swing of the golf club 1.

The distance between indentation 11 and the opposite surface should be far enough to allow the tips of the thumb and middle finger to rest firmly in the indentations 12, 13 that are meant for them. The overall dimensions of the unit 10 can be manufactured in different sizes for varying sizes of hands. Indentation 11 should have a radius of curvature that matches the radius of the club shaft 1 that it mates with. A typical radius is approximately 9/16".

Figure 4:
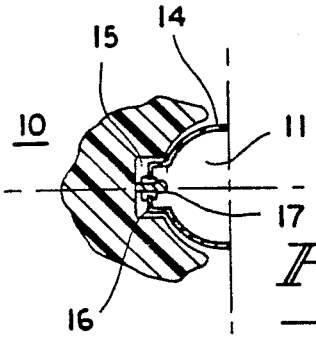
FIG. 4 is a cross-sectional view of the present invention showing the removable clip that can be used to mate with the club shaft.

An alternate way to mate the grip unit 10 to the club shaft is to use a removal clip 14 as shown in FIG. 4. The removal clip 14 would have the same radius of curvature as the indentation 11. The removal clip 14 would fit into the area normally taken by the indentation 11. Inset into the indentation is a recess 15 that serves to hold the removal clip 14 in place. The removal clip 14 has bottom protrusion 16 that matches the outline and shape of the recess 15 so as to fit snugly inside it. A pin 17 disposed through the removal clip protrusion 16 can be used to hold the removal clip 14 firmly in place.

FIG. 3 shows the grip unit 10 being used on a standard golf club. The player is still able to maintain the standard positioning of his hands with the thumb and middle finger spread apart. The hands can therefore operate as one unit as is desired in a golf swing. The resultant weakening of the right hand grip will increase the single extension of the left arm and the club.

The present invention can be molded in one piece from standard polymeric materials such as rubber, known plastics or solid foams. The material should have some resiliency so as to be comfortable to the person using it. Soft rubber that would not compress would withstand the shock of impact of the swing and would fit comfortably against the fingertips of the player.

It is to be understood that the present invention is not limited to the sole embodiment described above, but encompasses any and all embodiments within the scope of the following claims.

I claim:

1. A golf swing trainer device, consisting of:

a unitary body of generally hyperboloidal configuration having three major indentations in the outer surface of said body;

two of said three major indentations being laterally disposed opposite one another, said two indentations having substantially elliptical recess surfaces configured for accepting the respective tips of the thumb and middle finger on one hand of a gold player;

a third indentation of said three major indentations being vertically disposed between and adjacent said two indentations, said third indentation being a substantially semi-circular groove for accepting an abutting gold club shaft; wherein the gold player grips said body with his thumb and middle finger in the oppositely spaced two indentations with the golf club shaft disposed in the third indentation, the resulting grip weakening the strength in one hand and allowing for good extension through the other arm and golf club shaft with the ensuing swing.

2. The gold swing trainer device according to claim 1, wherein:

said third indentation has a constant axial radius of curvature, said radius of curvature being substantially equal to that of the golf club shaft.

3. The golf swing trainer device according to claim 1, including:

a removal clip mountable within said third indentation, said removal clip having a substantially identical outline to that of said third indentation for receiving said golf club shaft, whereby said golf swing trainer device is removably mounted on said gold club shaft.

4. The golf swing trainer device according to claim 3, including:

a recess in said third indentation, a protrusion on said clip, said protrusion snugly fitting within said recess of said third indentation.

5. The golf swing trainer device according to claim 1, wherein:

said unitary one piece body is molded from polymeric material.

* * * * *